US010806259B2

(12) United States Patent
Lemmo

(10) Patent No.: US 10,806,259 B2
(45) Date of Patent: Oct. 20, 2020

(54) LOUNGE CHAIR WITH ERGONOMIC FEATURES

(71) Applicant: Anthony Lemmo, LaSalle (CA)

(72) Inventor: Anthony Lemmo, LaSalle (CA)

( * ) Notice: Subject to any disclaimer, the term of this patent is extended or adjusted under 35 U.S.C. 154(b) by 17 days.

(21) Appl. No.: 16/300,074

(22) PCT Filed: May 10, 2017

(86) PCT No.: PCT/CA2017/050560
§ 371 (c)(1),
(2) Date: Nov. 9, 2018

(87) PCT Pub. No.: WO2017/193211
PCT Pub. Date: Nov. 16, 2017

(65) Prior Publication Data

US 2019/0150619 A1 May 23, 2019

Related U.S. Application Data

(60) Provisional application No. 62/333,430, filed on May 9, 2016.

(51) Int. Cl.

| | |
|---|---|
| ***A47C 4/00*** | (2006.01) |
| ***A47C 4/20*** | (2006.01) |
| ***A47C 17/64*** | (2006.01) |
| ***A47C 1/024*** | (2006.01) |
| ***A47C 3/04*** | (2006.01) |
| ***A47C 4/28*** | (2006.01) |
| ***A47C 1/03*** | (2006.01) |
| ***A47C 1/14*** | (2006.01) |
| ***A47C 7/62*** | (2006.01) |

(52) U.S. Cl.
CPC ..... *A47C 1/024* (2013.01); *A47C 1/03* (2013.01); *A47C 1/143* (2013.01); *A47C 3/04* (2013.01); *A47C 4/28* (2013.01); *A47C 7/62* (2013.01); *A47C 7/624* (2018.08)

(58) Field of Classification Search
CPC ..... A47C 1/143; A47C 20/026; A47C 17/66; A47C 17/70; Y10S 297/90
See application file for complete search history.

(56) References Cited

U.S. PATENT DOCUMENTS

| | | | | |
|---|---|---|---|---|
| 3,897,102 | A * | 7/1975 | Lemaire | A47C 1/143 5/656 |
| 4,252,371 | A * | 2/1981 | Lehnen | A47C 5/10 297/27 |
| 4,508,384 | A * | 4/1985 | Castelot | A47C 1/143 297/108 |

(Continued)

*Primary Examiner* — Shin H Kim
(74) *Attorney, Agent, or Firm* — Miller Canfield

(57) ABSTRACT

A lounge chair includes a frame including an upper body section, and a lower body section, a support section and support material. The upper body section is operatively coupled to the lower body section to pivot between a plurality of angular positions. The upper body section includes an aperture extending through the support material to receive the face of an individual when lying in a supine position. The lower body section is operatively coupled to the support section with an anterior tilt. The lounge chair includes armrests which pivot incrementally between a plurality of angular positions in a direction transverse, parallel or both transverse and parallel to a plane of a side member of the lower body section.

12 Claims, 18 Drawing Sheets

(56) References Cited

U.S. PATENT DOCUMENTS 4,606,086 A * 8/1986 Rowland ..... A47C 1/143 2/202
4,877,288 A * 10/1989 Lee ..... A47C 1/143 297/229
5,222,779 A 6/1993 Johnson
5,322,342 A * 6/1994 Gange ..... A47C 1/14 239/289
5,620,229 A * 4/1997 Ledford ..... A47C 1/143 297/183.5
5,624,157 A * 4/1997 Kostuk ..... A47C 17/82 297/228.13
5,913,572 A * 6/1999 Grimaldi ..... A47C 1/143 297/188.04
5,926,871 A * 7/1999 Howard ..... A47C 1/143 297/900
5,946,749 A 7/1999 Sewell
5,950,259 A * 9/1999 Boggs ..... A47C 1/143 297/900
D423,240 S * 4/2000 White ..... D6/361
6,938,287 B1 9/2005 Mahshie
7,581,788 B1 * 9/2009 Johnson ..... A47C 1/143 297/184.11
7,959,222 B1 * 6/2011 Powell ..... A47C 1/143 297/188.06
7,963,592 B1 * 6/2011 Stanley ..... A47C 1/143 297/31
8,668,268 B1 * 3/2014 Cormack ..... A47C 1/026 297/354.13
8,708,406 B1 * 4/2014 Powell ..... A47C 21/00 297/188.06
9,101,219 B2 * 8/2015 Smith ..... A47C 20/026
9,439,509 B2 * 9/2016 Cammarata ..... A47B 91/06
2002/0124310 A1 * 9/2002 Takeuchi ..... A47C 1/143 5/111
2005/0262641 A1 * 12/2005 Maslyar ..... A47C 1/14 5/725
2005/0264049 A1 * 12/2005 Fleites ..... A47C 1/143 297/188.04
2006/0071513 A1 * 4/2006 Pedemonte ..... A47C 1/143 297/16.1
2014/0183909 A1 * 7/2014 Smith ..... A47C 20/026 297/115
2015/0320188 A1 * 11/2015 Lindner ..... A45F 4/06 224/156
2018/0249836 A1 * 9/2018 Wise ..... A47C 1/143
2018/0344032 A1 * 12/2018 Eskridge, III ..... A47C 1/143
2019/0150619 A1 * 5/2019 Lemmo ..... A47C 1/03

* cited by examiner

LOUNGE CHAIR WITH ERGONOMIC FEATURES

CROSS-REFERENCE TO RELATED APPLICATIONS

This application claims priority to and all the benefits of U.S. Provisional Application No. 62/333,430, filed on May 9, 2016 and entitled "Lounge Chair With Ergonomic Features."

BACKGROUND OF THE INVENTION

Field of the Invention

The present invention relates to a lounge or deck chair, especially those used for outdoor recreation. More particularly, the present invention relates to a lounge chair having ergonomic features that are beneficial to an individual lying on the lounge chair in a supine or prone position.

Description of Related Art

A typical lounge chair configuration generally includes three sections. A central section remains fixed and is supported by legs at opposite ends thereof. Two outer sections are joined to the opposite ends of the central section by a ratcheting mechanism which permits the respective outer sections to pivot relative to the central section. The two outer sections may be positioned at angles determined by an individual using the lounge chair. One outer section is formed to accommodate the individual's upper body, such as the head and shoulders, while the other outer section is formed to accommodate the individual's lower body, such as the legs. The lounge chair may be folded compactly for storage or transport by pivoting one of the two outer sections generally flat against an upper surface of the central section and pivoting the other of the two outer sections generally flat against the outer section that was previously pivoted against the central section. The legs pivot against a lower surface of the central section.

The typical lounge chair, however, is particularly uncomfortable when an individual is lying in a downwardly-facing supine or upwardly-facing prone position and requires that the individual turn their head to more fully relax. While in the supine or prone position, the arms of the individual tend to dangle awkwardly to the ground. Additionally, reading a book in the supine or prone position requires the individual to raise themselves on their elbows or forearms, which quickly leads to discomfort and fatigue.

There are numerous examples of lounge chair designs which attempt, with varying degrees of success, to address physical discomfort and lack of utility when lying in the supine or prone position. The exemplary embodiments detailed herein addresses the issues associated with previous lounge chair designs by providing ergonomic features as detailed below.

SUMMARY OF THE INVENTION

An exemplary embodiment of the disclosure involves a lounge chair for supporting an individual in a supine or prone position. The lounge chair can be for personal or medical purposes inclusive of post eye surgery recoveries, post sinus surgeries wherein a person is prescribed to sleep in a prone position for many consecutive days. In these instances patients have to sleep or recover using conventional home furnishings such as a living room couch where towels and/or other materials are used to form a relief from facial compressions. The exemplary lounge chair will alleviate any of these discomforts and allow a patient to recover without incident from undesired facial discomforts.

The lounge chair includes a frame and a support material. The frame comprises an upper body section, a lower body section and a support section. The upper body section is operatively coupled at one end to the lower body section to pivot between a plurality of angular positions, and detachably coupled to the support section at an opposing end. The upper body section includes an aperture extending through the support material to receive the face of an individual when lying in the supine position. The lower body section is permanently coupled to the support section. Each of the frame sections are extruded as one piece. The one piece extruded structure of the lower body section and support sections are designed to support the upper body section while maintaining the individual lying on the support material in a spaced relation above a floor or ground surface.

BRIEF DESCRIPTION OF THE DRAWINGS

Advantages of the present disclosure will be readily appreciated as the same becomes better understood by reference to the following detailed description when considered in connection with the accompanying drawings wherein.

DETAILED DESCRIPTION OF THE EMBODIMENTS

Figure 1:
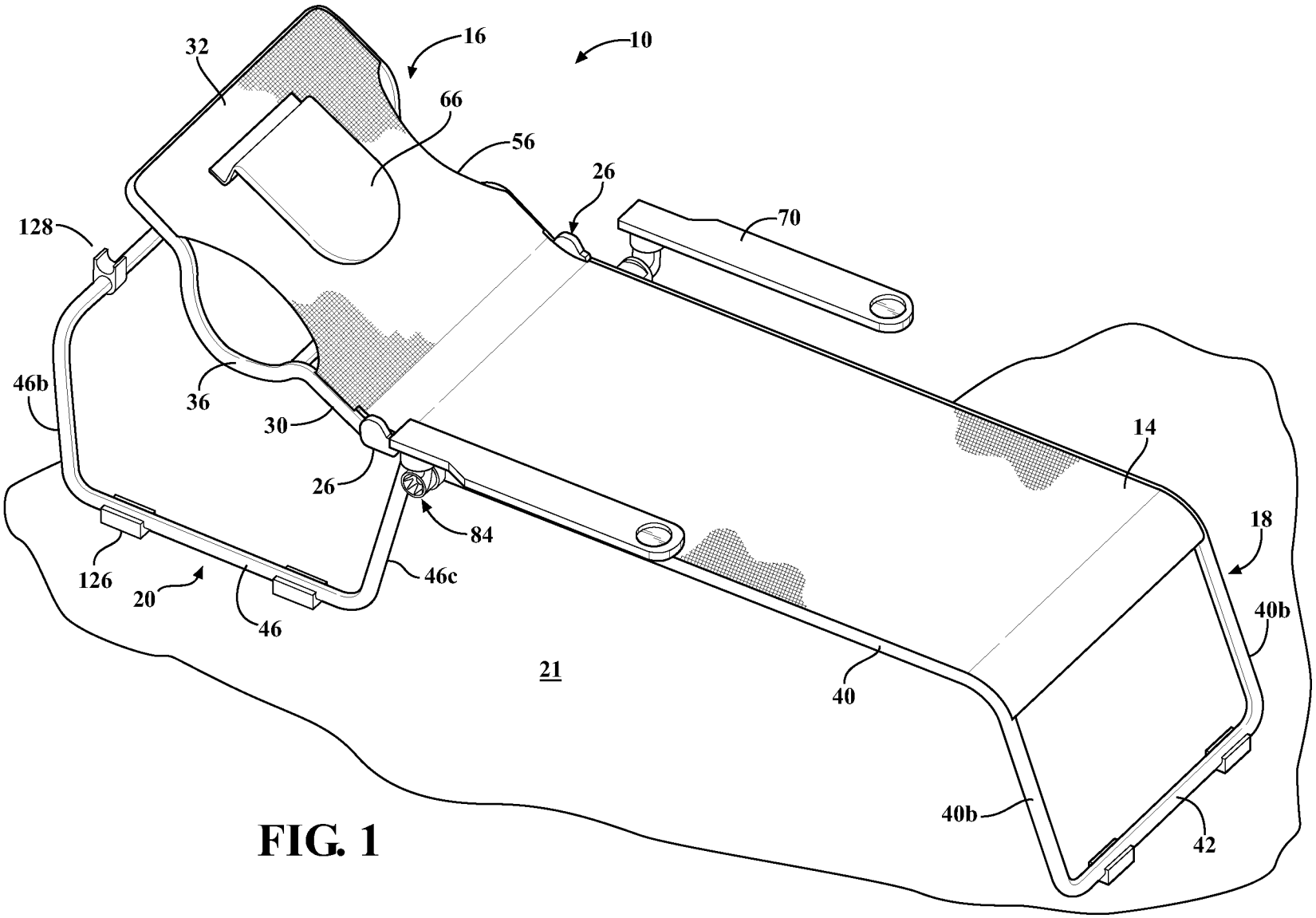
FIG. 1 is a perspective view of a lounge chair in a comfort seating position.
Figure 2:
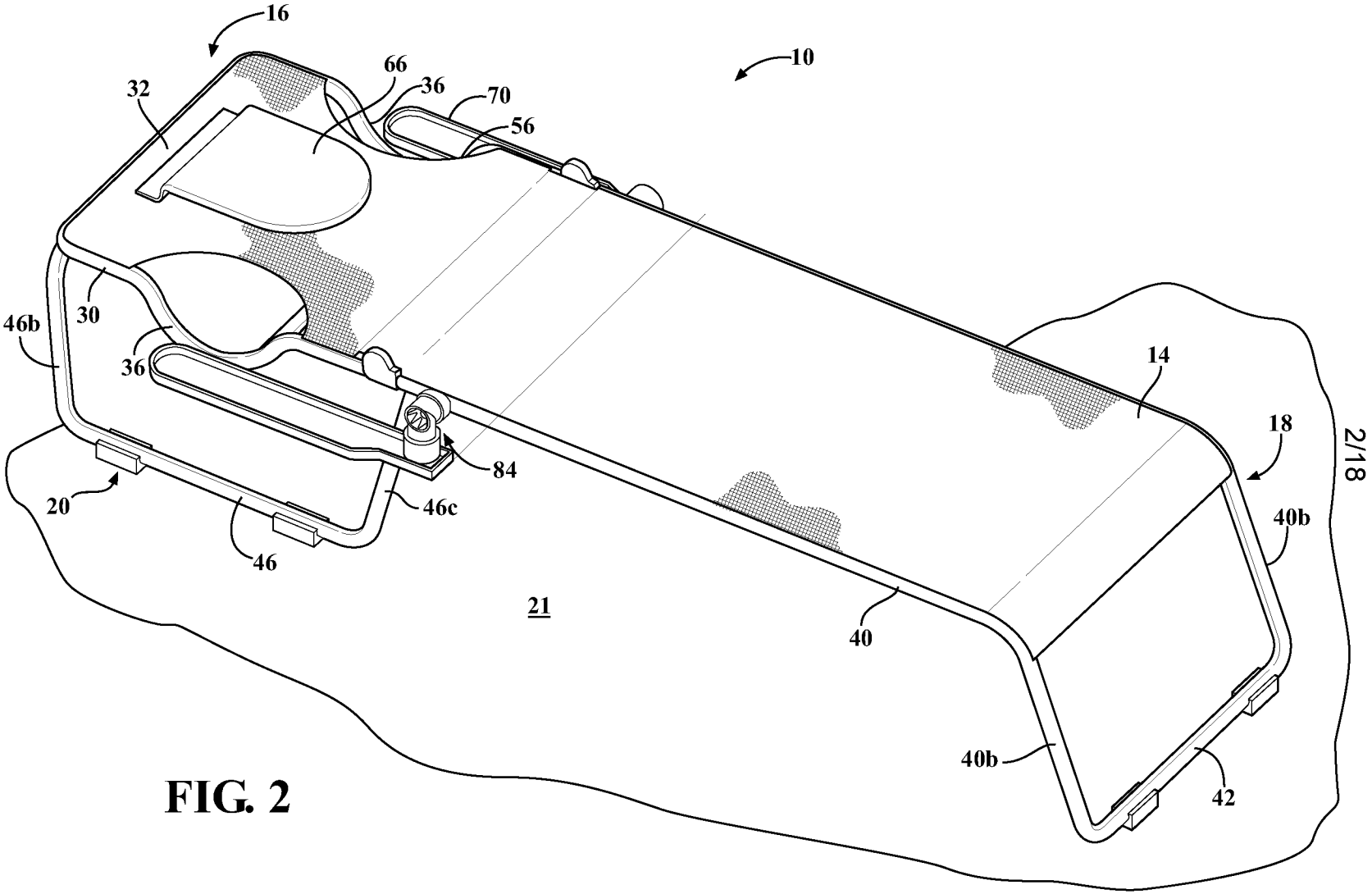
FIG. 2 is a perspective view of the lounge chair in a laying position.
Figure 3A:
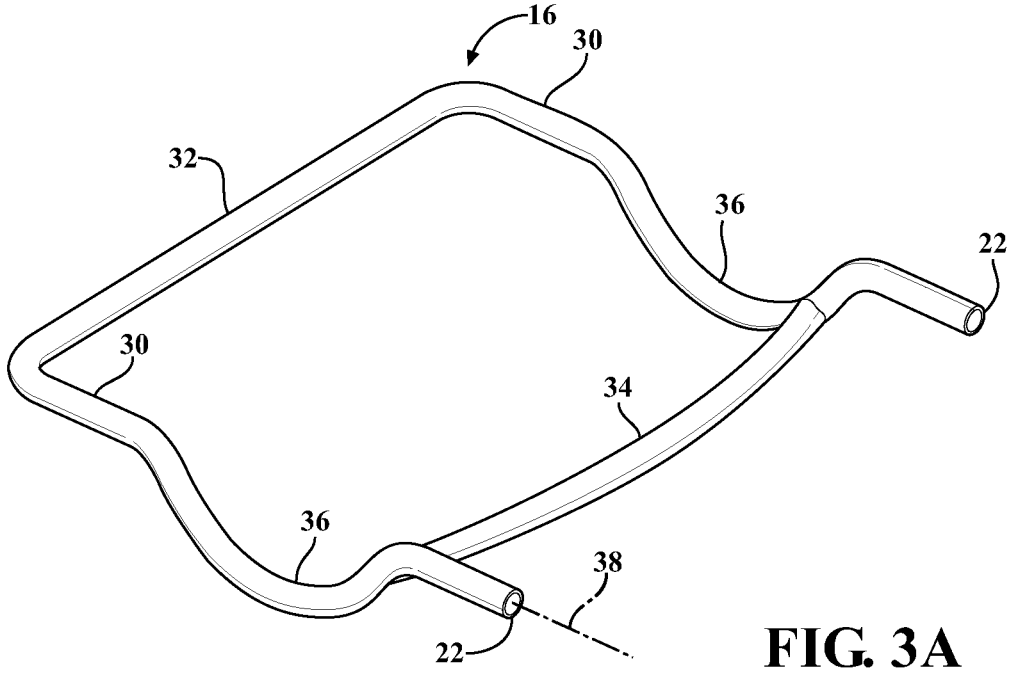
FIG. 3A is a perspective view of the upper body section.
Figure 3C:
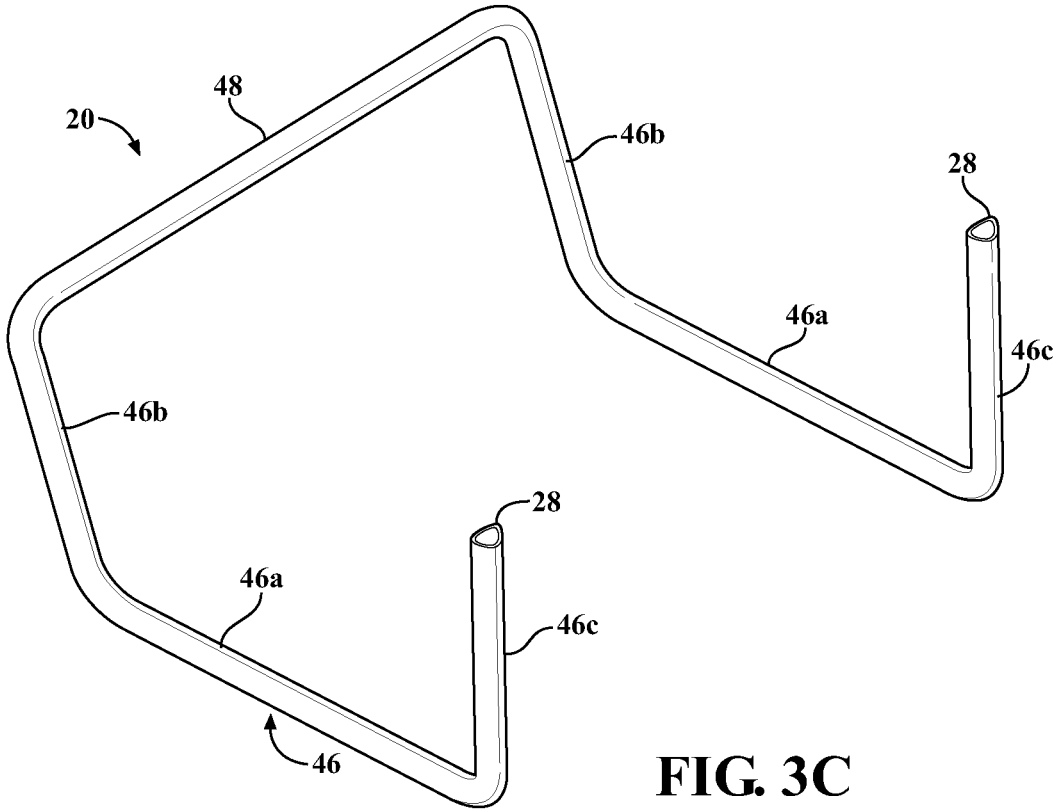
FIG. 3C is a perspective view of the support section.
Figure 3B:
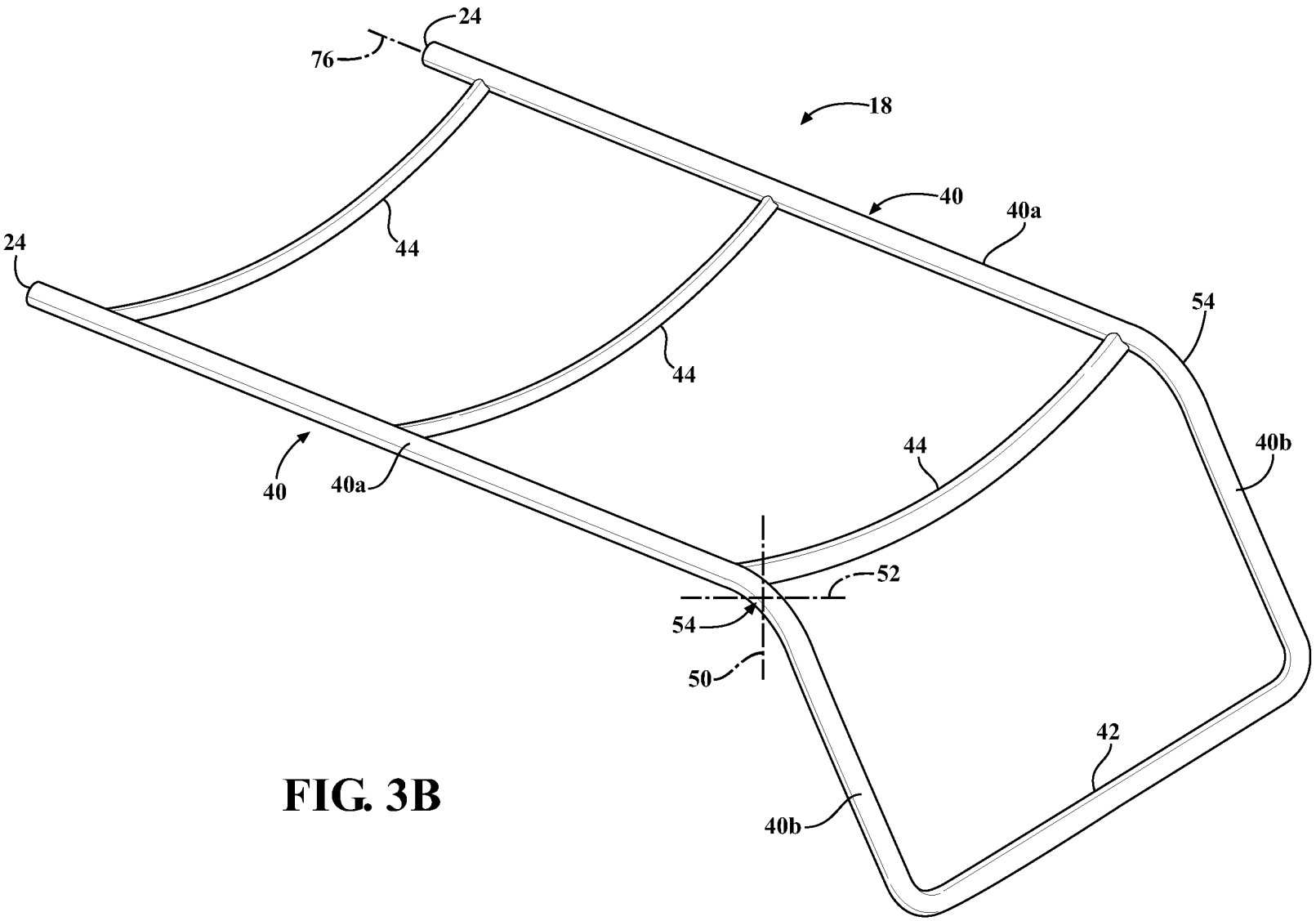
FIG. 3B is a perspective view of the lower body section.
Figure 3D:
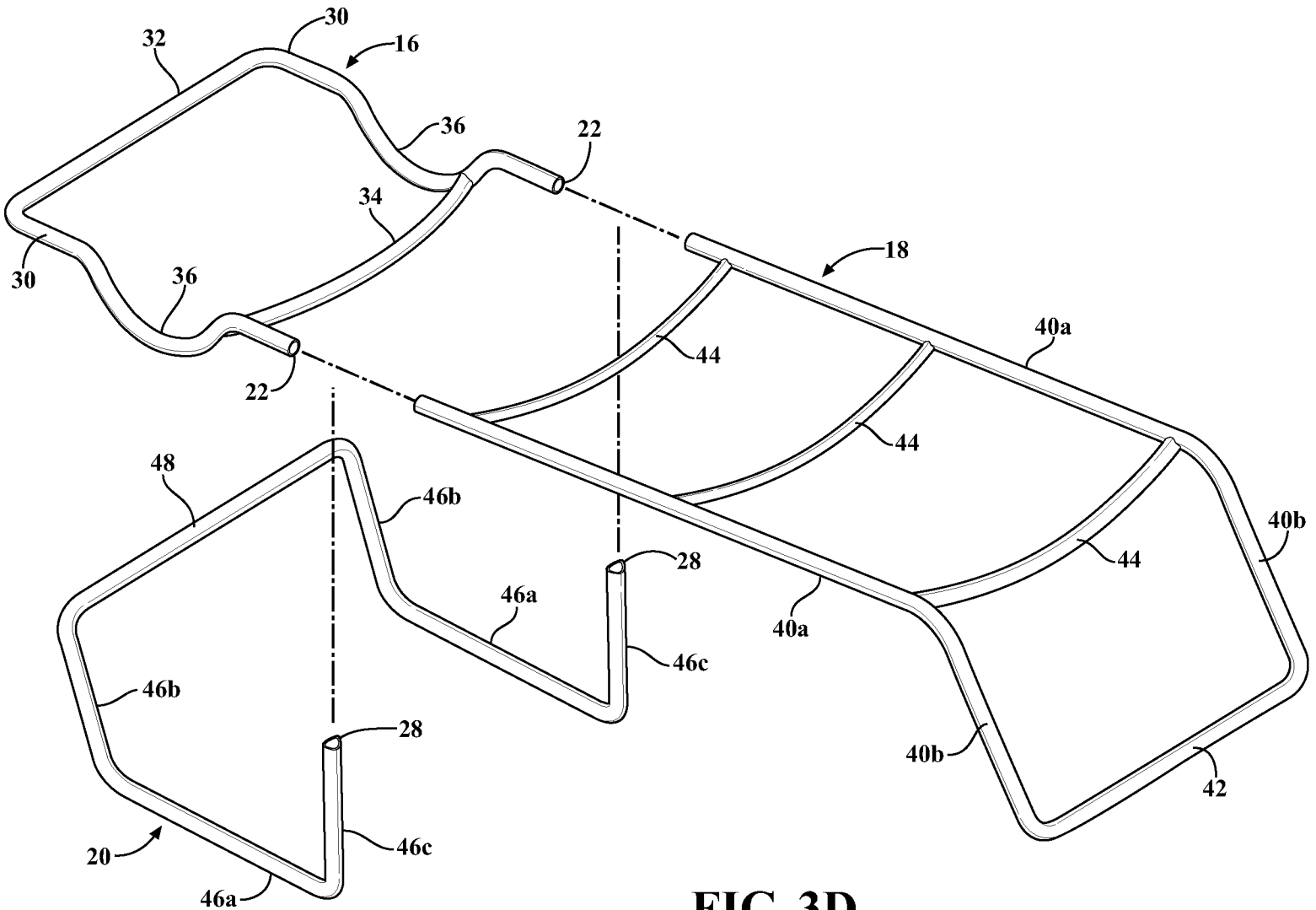
FIG. 3D is an exploded perspective view of the frame.

Referring to the FIGS. 1 and 2, a lounge chair is illustrated generally at 10. The lounge chair 10 includes a frame 12 and support material 14. The frame 12 comprises and upper body section 16, a lower body section 18 and a support section 20. The support material 14 is affixed to the frame 12 for supporting an individual above a floor or ground surface 21. The frame 12 may be comprised of aluminum, wood, metal, plastic, or any suitably strong and lightweight material. The upper body section 16, the lower body section 18 and the support section 20 are each formed individually as an extruded hollow tubular structure. The support material 14 may include sheet material, individual straps, webs of interlaced material, or any combination thereof. The support material 14 may be comprised of cloth, canvas, vinyl, plastic or any suitably flexible and resilient material.

Referring also to FIGS. 3A-3D, the upper body section 16 includes distal ends 22. Distal ends 22 of the upper body section 16 are operatively coupled to first ends 24 of the lower body section 18 by a pair of ratcheting mechanisms 26. The ratcheting mechanisms 26 allow the upper body section 16 to pivot relative to the lower body section 18. As is well known in the art, the ratcheting mechanisms 26 are bi-directional and operable to maintain the upper body section 16 in any of a plurality of angular positions with respect to the lower body section 18 and the support section 20. The support section 20 includes free ends 28 that are permanently coupled to the first ends 24 of the lower body section 18. The support section 20 is permanently coupled to the lower body section 18 by any suitable permanent attachment means such as by welding.

Referring more particularly to FIGS. 3A-3D, the upper body section 16 includes side members 30 spaced apart by a top member 32 and a lower member 34 that extends transversely between the side members 30. The lower member 34 serves as structural support for the upper body section 16. As a structural support, lower member 34 is contoured such that the contour is curved in a direction away from side members 30 and the support material 14, towards the floor or ground 21. The support material 14 extends between and is affixed to the side members 30 such that the support material 14 is suitably tensioned therebetween. Each side member 30 is contoured to include a shoulder drop 36 to provide clearance for the arms and shoulders of an individual when lying in the supine or prone position. The shoulder drop 36 is formed by a portion of the side member 30 wherein the contour of the shoulder drop 36 is such that the contoured or curved portion is offset or disposed below a plane 38 defined by the side members 30. With the lounge chair 10 in the laying position, the shoulder drop 36 is contoured in a direction away from side members 30 and the support material 14, towards the floor or ground 21. Thus, when the individual is lying on the lounge chair 10 in the supine or prone position, their shoulders and arms do not come into contact with the side members 30.

The lower body section 18 includes side members 40 spaced apart by a bottom member 42 and intermediate members 44 that extend transversely between the side members 40. Intermediate members 44 serve as structural supports for the lower body section 18. As structural support, intermediate members 44 are also contoured such that the contours are curved in a direction away from side members 40 and the support material 14, towards the floor or ground 21. The curved contour of intermediate members 44 allows a person to lie on the lounge chair 10 without having the added pressure of a bar on the shins of a person especially when the person is lying in the prone position. Side members 40 include a first portion 40*a* and a second portion 40*b* angled with respect to the first portion 40*a*. The angled second portions 40*b* of the side members 40 are configured to extend outwardly away from a plane 50 that is normal to a plane 52 of the lower body section 18 and extend towards the bottom member 42 to provide a lower support for the frame 12. Bottom member 42 is configured to be disposed generally parallel with and rest flush with the floor or ground 21 to rest thereupon. Intermediate members 44 are equidistantly spaced between the side members 40 beginning at an intersection 54 of the first portion 40*a* and the second portion 40*b* of the side members 40 outwardly to the first ends 24 of the lower body section 18. The support material 14 extends between and is affixed to the side members 40 such that the support material 14 is suitably tensioned therebetween.

The support section 20 includes side members 46 spaced apart by a top member 48 that extends transversely therebetween. Side members 46 include a first portion 46*a*, and second 46*b* and third 46*c* portions angled with respect to the first portion 46*a*. The angled second portion 46*b* of the side members 46 extend upwardly and away from a first end of the first portion 46*a* and are configured to extend to the top member 48 to provide support for the frame 12. The angled third portion 46*c* extend upwardly and away from an opposing end of the first portion 46*a* and includes free ends 28 that are coupled to the first ends 24 of the lower body section 18. The second 46*b* and third 46*c* portions flare outwardly from the first portion 46*a* at an angle of five degrees with respect to the top member 48. Flaring the second 46*b* and third 46*c* portions with respect to the top member 48 allows the support section to accommodate more weight thereon and provides added stability thereby preventing the lounge chair 10 from potentially tipping over if more weight is applied to either an uppermost or lowermost portion of the lounge chair 10. The first 46*a*, second 46*b* and third 46*c* portions of the side members form a shape similar to a u-shape wherein the first portion 46*a* is configured to be disposed generally parallel to the floor or ground 21 to rest thereupon. Top member 48 of the support section 20 is configured to provide support for the upper body section 16 wherein the top member 32 of the upper body section 16 rests securely thereon when the upper body section 16 is pivoted to the laying position.

Figure 4:
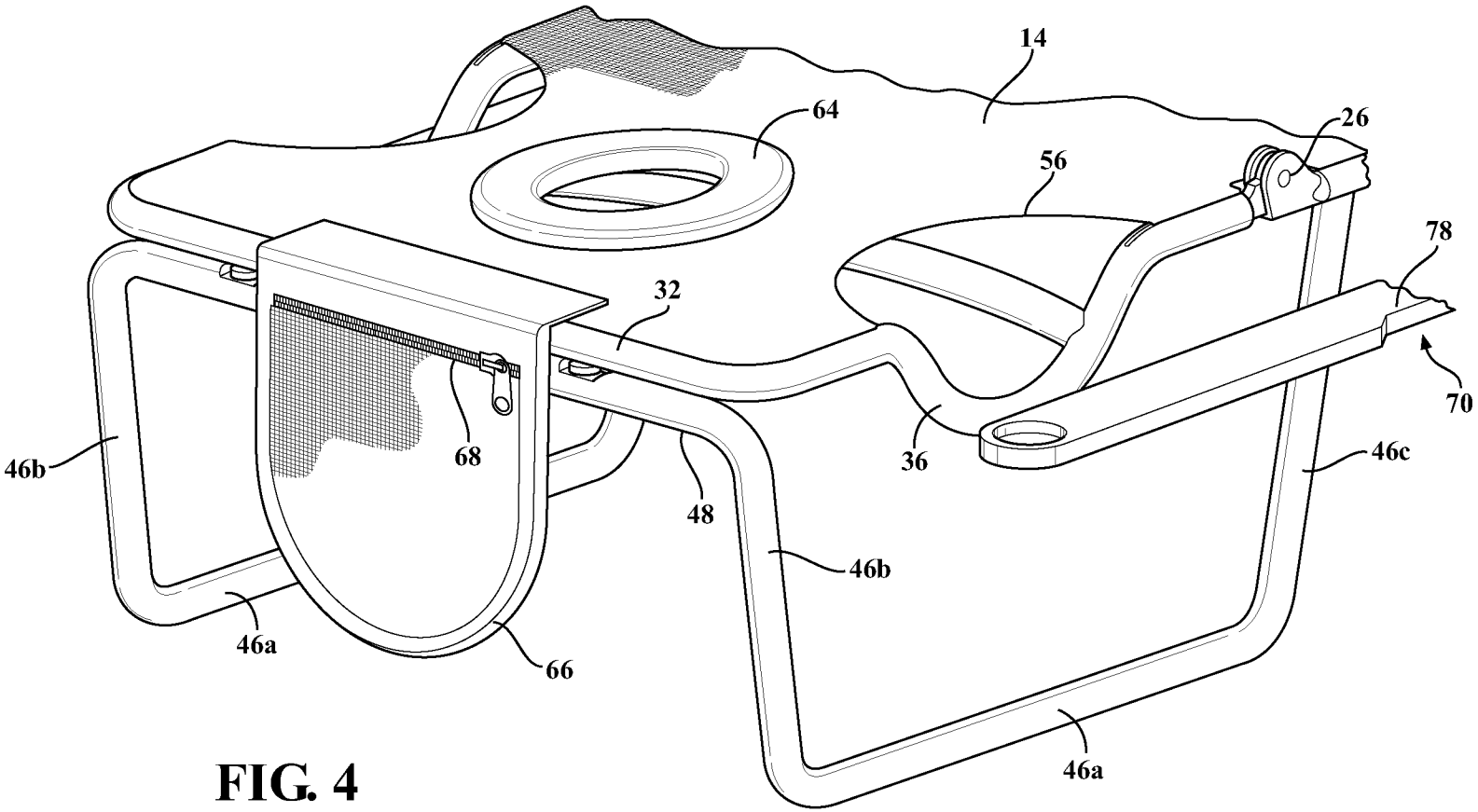
FIG. 4 is a fragmentary side view of an upper body section of the lounge chair illustrating a shoulder drop.
Figure 5:
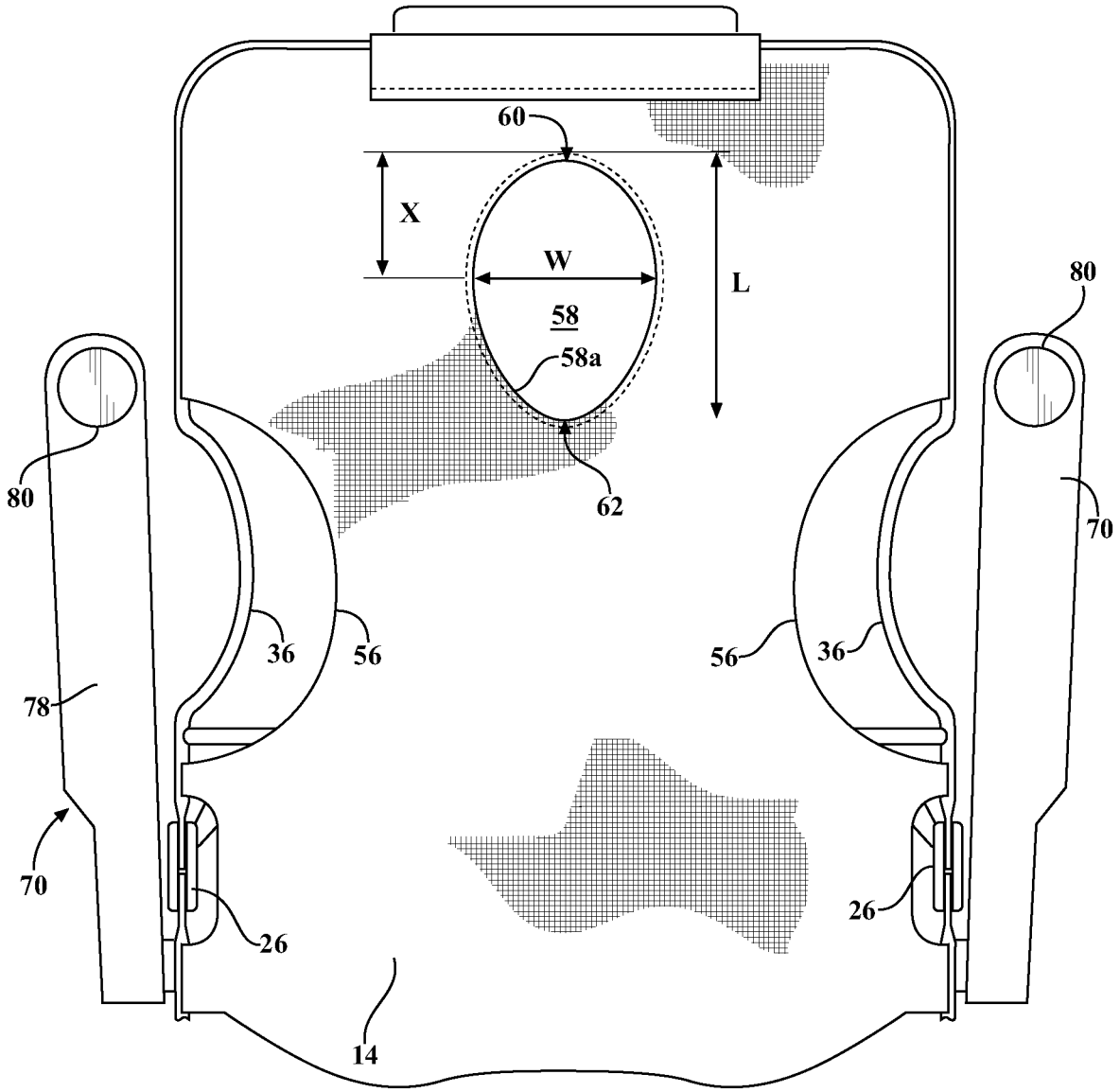
FIG. 5 is a fragmentary top view of the upper body section of the lounge chair illustrating an aperture for a face of an individual.

Referring to FIGS. 4 and 5, the support material 14 affixed between the side members 30 of the upper body section 16 includes semi-circular cutouts 56 that are generally vertically aligned with the shoulder drops 36. As such, a width of the support material 14 in the region of the shoulder drops 36 is less than a width of the support material 14 adjacent the top member 32 and a width of the support material 14 adjacent to the lower body section 18. The cutouts 56 allow the arms of the individual to extend underneath the upper body section 16 when lying on the lounge chair 10 in the supine position. This allows the individual to reach under the lounge chair 10 to hold/turn pages of a book or magazine, send text messages on a mobile phone, or perform other tasks. Cutouts 56 are preferably arcuate in shape, but may be any shape suitable for comfortably allowing the arms of an individual to dangle below the upper body section 16 without making substantial contact with the lounge chair frame 12.

An aperture 58 extends through the support material 14 in the upper body section 16. The aperture 58 is positioned generally towards the top member 32 and is adapted to receive the face of the individual when lying on the lounge chair 10 in the supine position. The aperture 58 allows the individual to lie in the supine position without turning their head while at the same time being able to see through the aperture 58 to read a book or the like. The aperture 58 is designed so that an edge 58*a* of the support material 14 surrounding the aperture 58 may contact the forehead, chin, and cheek bones of the individual. The aperture 58 is anatomically designed to conform to the face of an individual and may define a generally oblong shape. More specifically, the aperture 58 extends between a top end 60 and a bottom end 62 and defines a length L that is preferably in a range of 17.0 centimeters to 21.6 centimeters, and more preferably the length L is approximately 19.4 centimeters. The aperture 58 defines a width W that is preferably in a range of 11.7 centimeters to 14.7 centimeters, and more preferably the width W is approximately 13.5 centimeters. The width W of the aperture 58 is located a predetermined distance X from the top 60 of the aperture 58. The predetermined distance X is preferably in a range of 10.4 centimeters to 11.0 centimeters, and more preferably is approximately 10.8 centimeters.

A ring-shaped cushion 64 may be secured to the support material 14 of the upper body section 16 or formed therewith to provide added comfort when the individual is lying on the lounge chair 10 in the supine position. In addition, a padded flap 66 may also be pivotally secured to the support material 14 of the upper body section 16 to provide added comfort when the individual is lying on their back on the lounge chair 10 in the supine position. Thus, the padded flap 66 can be pivoted onto the support material 14 of the upper body section 16 in order to cover the ring-shaped cushion 64 and the aperture 58. It is contemplated that, when the individual is lying in either a face-down position or on their back, an underside of the padded flap 66 may include a pocket 68 (best shown in FIG. 8) for storing personal items such as a wallet or keys. Pocket 68 can include a zipper, snaps, hook-and-loop, or other similar means to secure the personal items.

Figure 6:
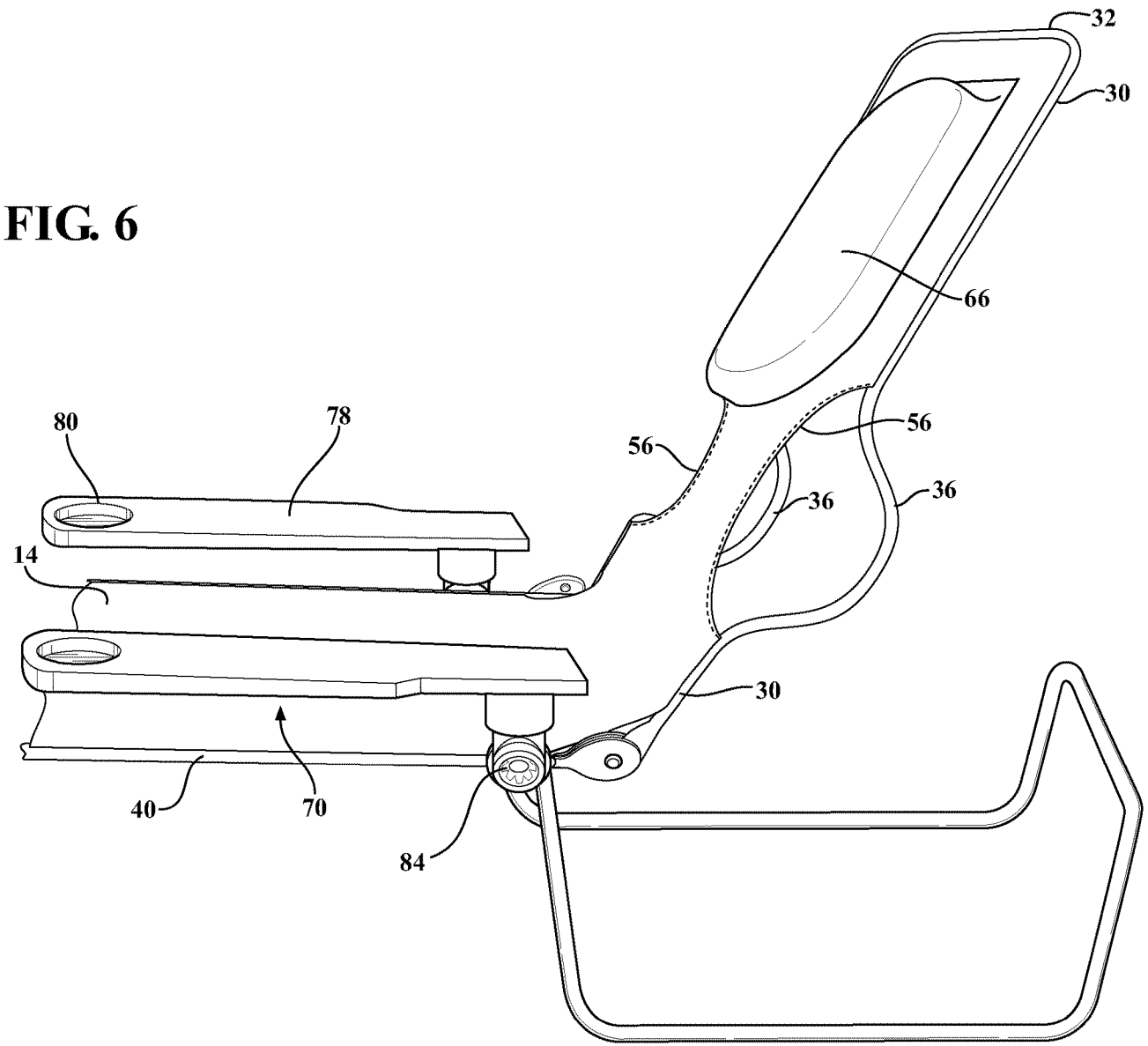
FIG. 6 is a fragmentary side view of the lounge chair in the comfort seating position with an armrest in a raised position.

As shown in FIG. 6, the individual using the lounge chair 10 can position their body in any number of positions depending on how the lounge chair 10 is arranged. The lounge chair 10 can be selectively arranged in a variety of positions. For example, the lounge chair 10 can be arranged in a comfort seating position, also shown in FIG. 1, wherein the upper body section 16 is disposed in a generally upright or angled position relative to the lower body section 18 and the support section 20. With the lounge chair 10 in the comfort seating position, it is understood that the individual would be in a seated position. It is appreciated that the upper body section 16 may also be reclined to lower the head and shoulders of the individual as desired.

Figure 7:
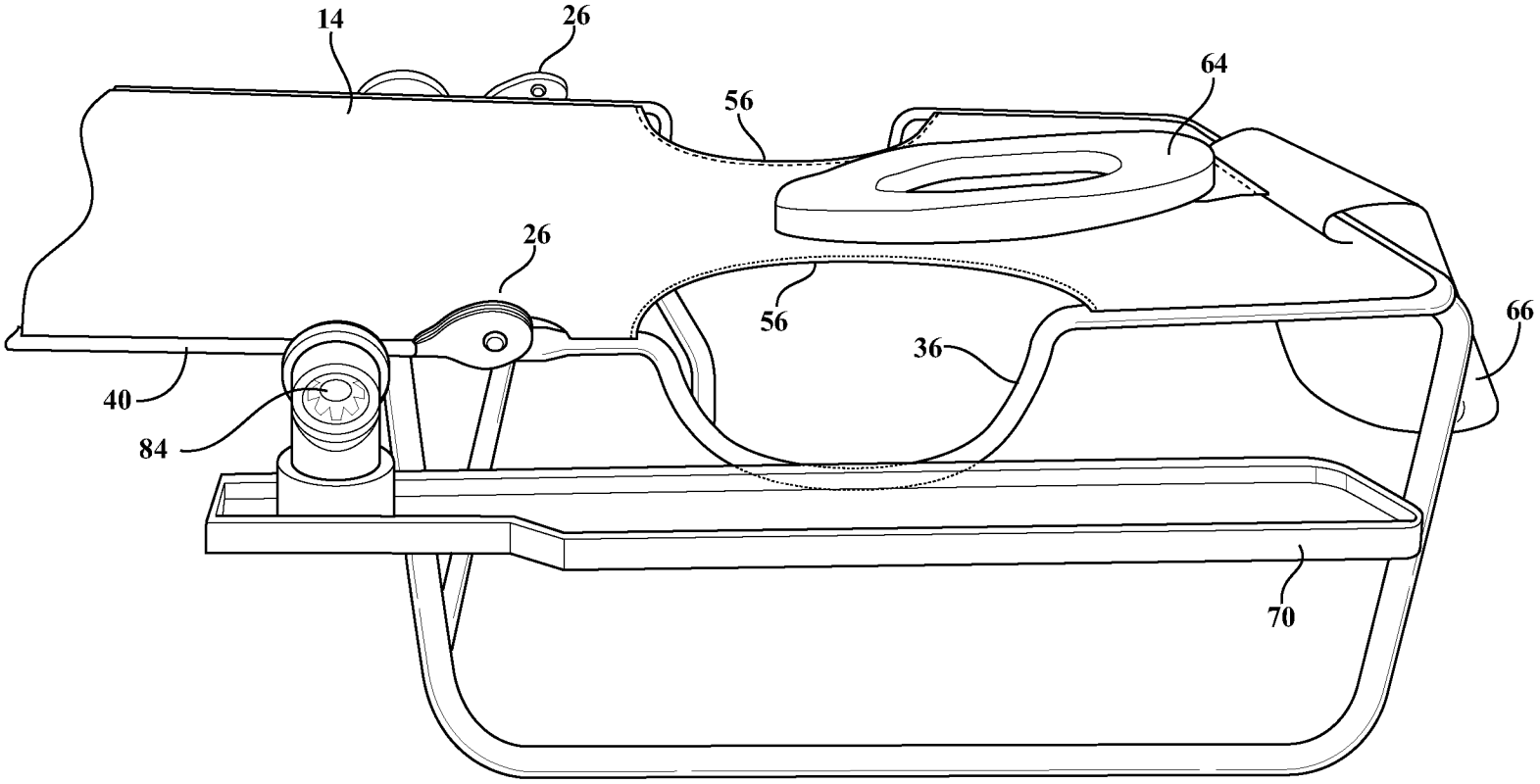
FIG. 7 is a fragmentary side view of the lounge chair in the laying position with the armrest in a lowered position.

As shown in FIG. 7, the lounge chair 10 can also be arranged in a laying position, also shown in FIG. 2, wherein the upper body section 16 is disposed in a generally flat position and the lower body section 18 is also disposed in the generally flat position. With the lounge chair 10 in the laying position, it is understood that the individual may be in an upward-facing supine position or a downward-facing prone position. It is further appreciated that the upper body section 16 may be pivoted upwardly to raise the head and shoulders of the individual as desired.

Figure 8:
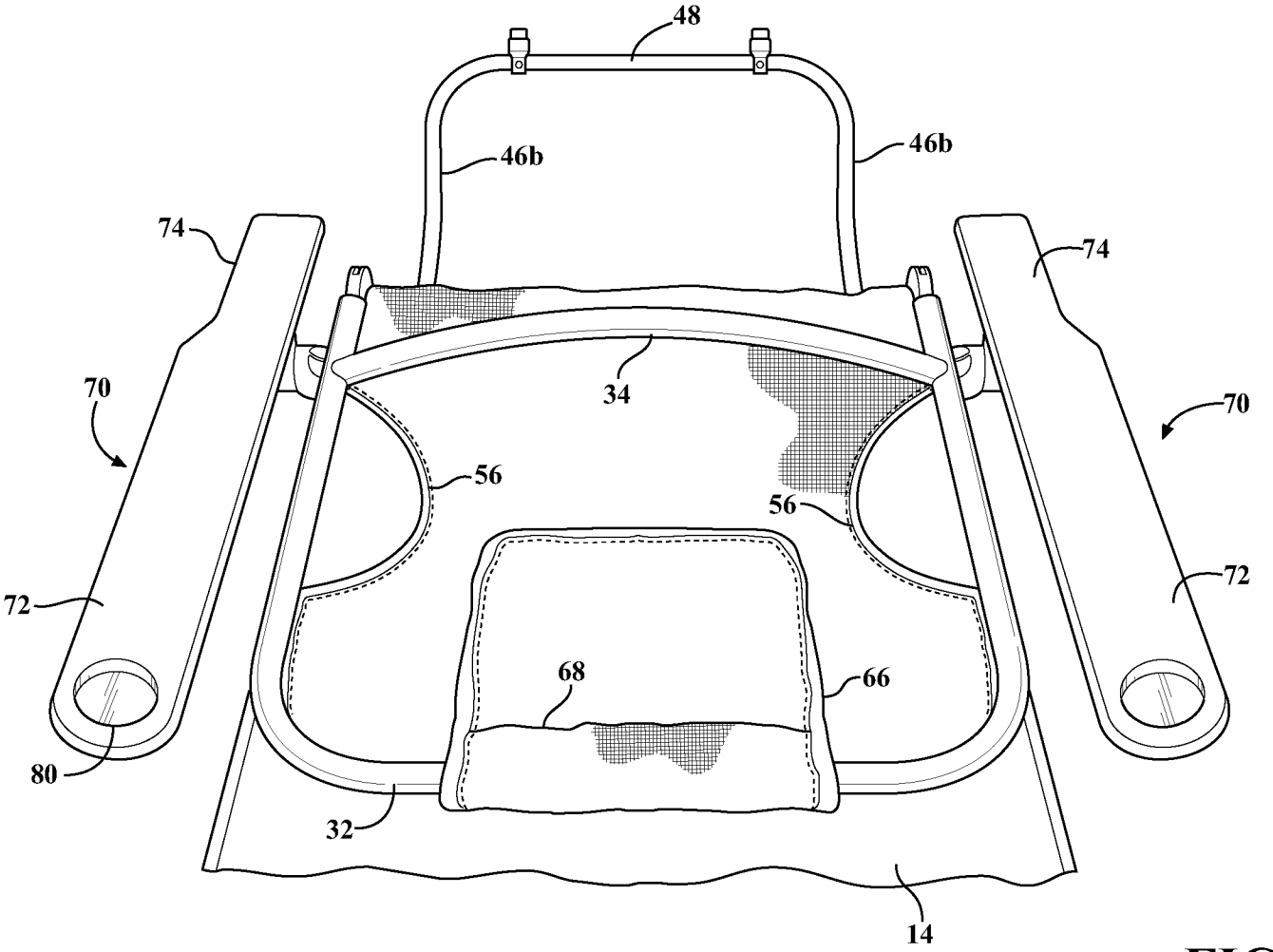
FIG. 8 is a fragmentary front view of the lounge chair illustrating the upper body section folded upon the lower body section.

As shown in FIG. 8, the lounge chair 10 can be folded for storage or transport. When the lounge chair 10 is folded for storage or transport, the upper body section 16 is disposed in a folded position directly adjacent the lower body section 18.

In further regards to FIGS. 6-8, a pair of armrests 70 is operatively coupled to the first portions 40*a* of side members 40 of the lower body section 18. The armrests 70 are generally flat-shaped and are movable between a lowered position, shown in FIG. 6, when the lounge chair 10 is in the comfort seating position, and a raised position, shown in FIG. 7, when the lounge chair 10 is in the laying position. Each armrest 70 includes a widened elongated primary portion 72 and a secondary more slender or narrowed portion 74 that extends therefrom. The secondary portion 74 of each armrest 70 is operatively coupled to the first portions 40*a* of the side members 40 and permits the armrest 70 to pivot relative to the support section 18. In the lowered position, the armrests 70 extend alongside the lower body section 18. More specifically, with the armrests 70 in the lowered position, the primary portion 72 is offset above a horizontal plane defined by the side members 40 of the lower body section 18 and an upper surface 78 of the armrest 70 is positioned for supporting the arm of an individual. In the lowered position, the secondary portion 74 extends generally downward and the primary portion 72 extends alongside the upper body section 18. The upper surface 78 of the primary portion may include a cup or drink receiving portion 80. Additionally, with the armrests 70 in the raised position, the primary portion 72 is offset below the plane 76 defined by the side members 40 of the lower body section 18 and a lower surface 82 of the armrest 70 is positioned for supporting the arms of an individual. While a preferred armrest 70 contains a widened primary portion 72 and a narrower secondary portion 74, the armrest 70 may have a consistent width throughout without having a widened area.

It is therefore contemplated that the armrests 70 may translate in a direction of the upper body section 16 as the armrests 70 move from the lowered position to the raised position. In contrast, the armrests 70 may translate in a direction of the lower body section 18 as the armrests 70 move from the raised position to the lowered position. It is further contemplated that the lounge chair 10 may or may not include the armrests 70. Additionally, the armrests 70 may be positioned in one or more intermediate positions, disposed between the raised position and the lowered position, for use when the upper body section 16 is in any of the various anticipated reclining positions.

Figure 9A:
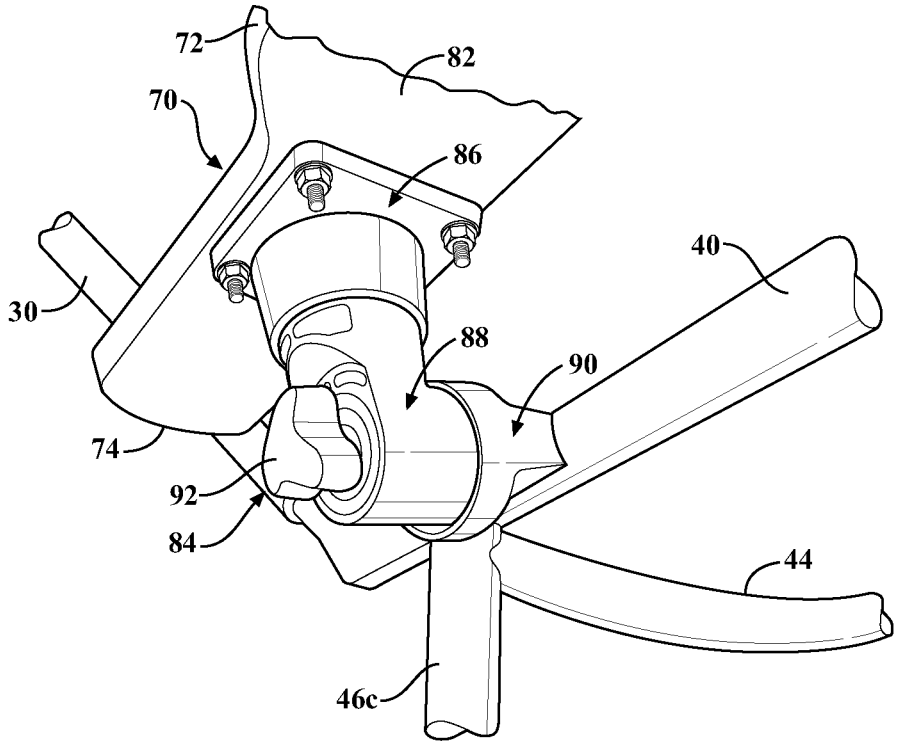
FIG. 9A is a detailed view of the multi-directional knuckle assembly for pivotally supporting the armrest.
Figure 9B:
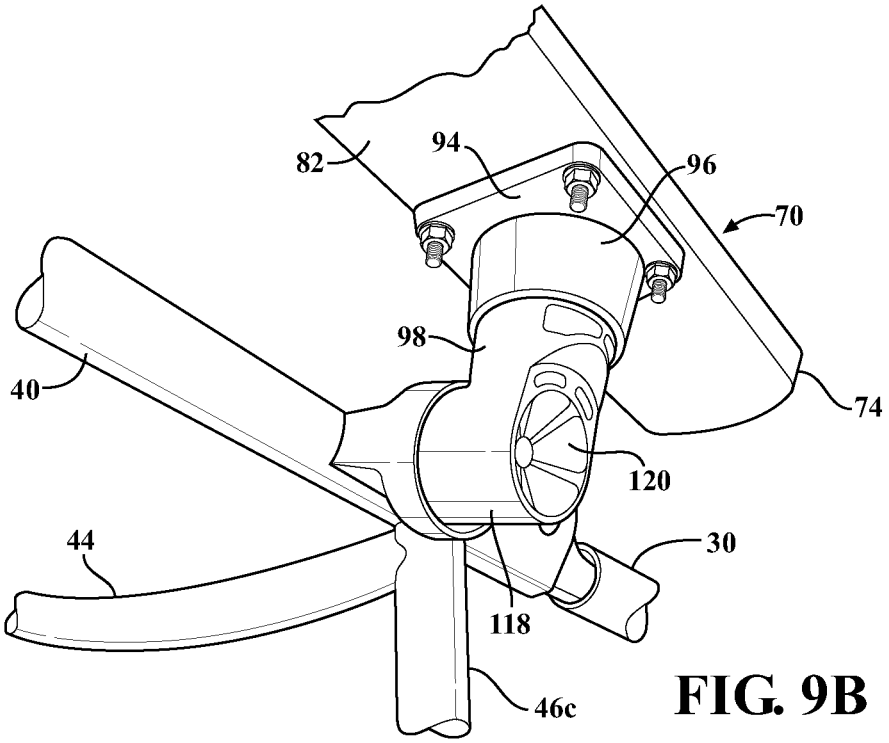
FIG. 9B is a detailed view of the multi-directional knuckle assembly without the adjustment knob.
Figure 9C:
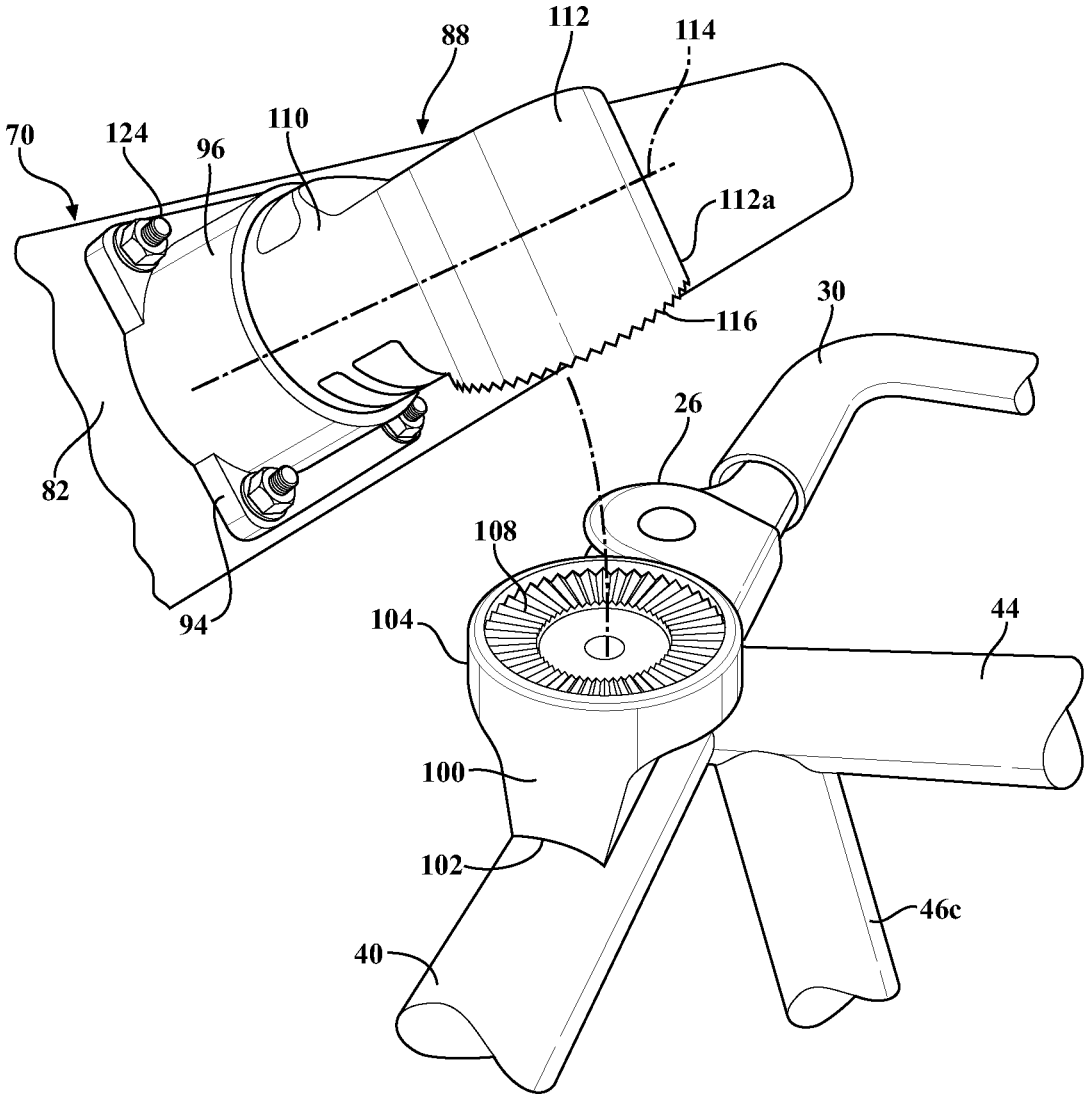
FIG. 9C is an exploded detailed view of the multi-directional knuckle assembly disassembled.
Figure 10A:
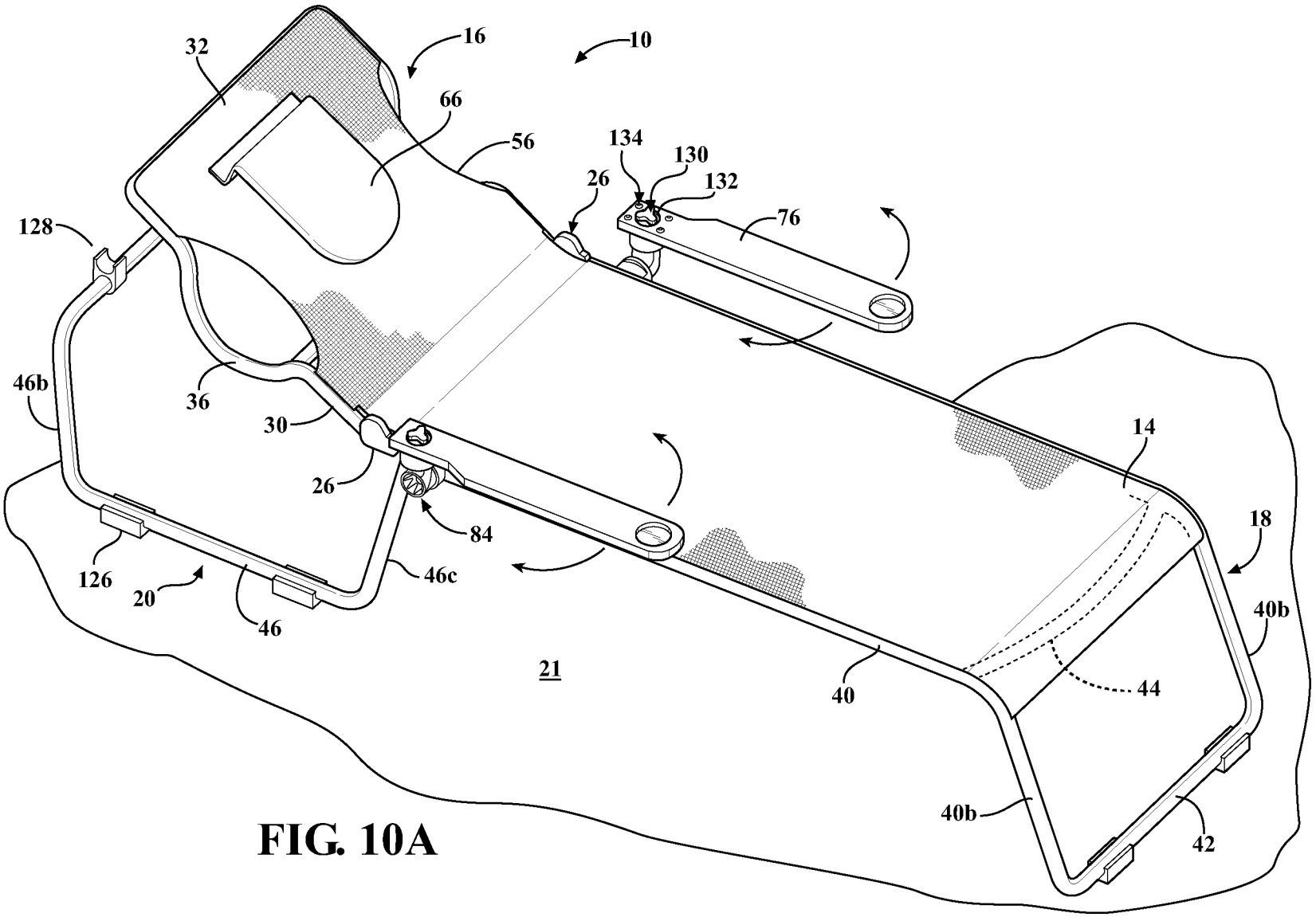
FIG. 10A is a perspective view of the lounge chair in a comfort seating position detailing another aspect of the multi-directional knuckle assembly.
Figure 10B:
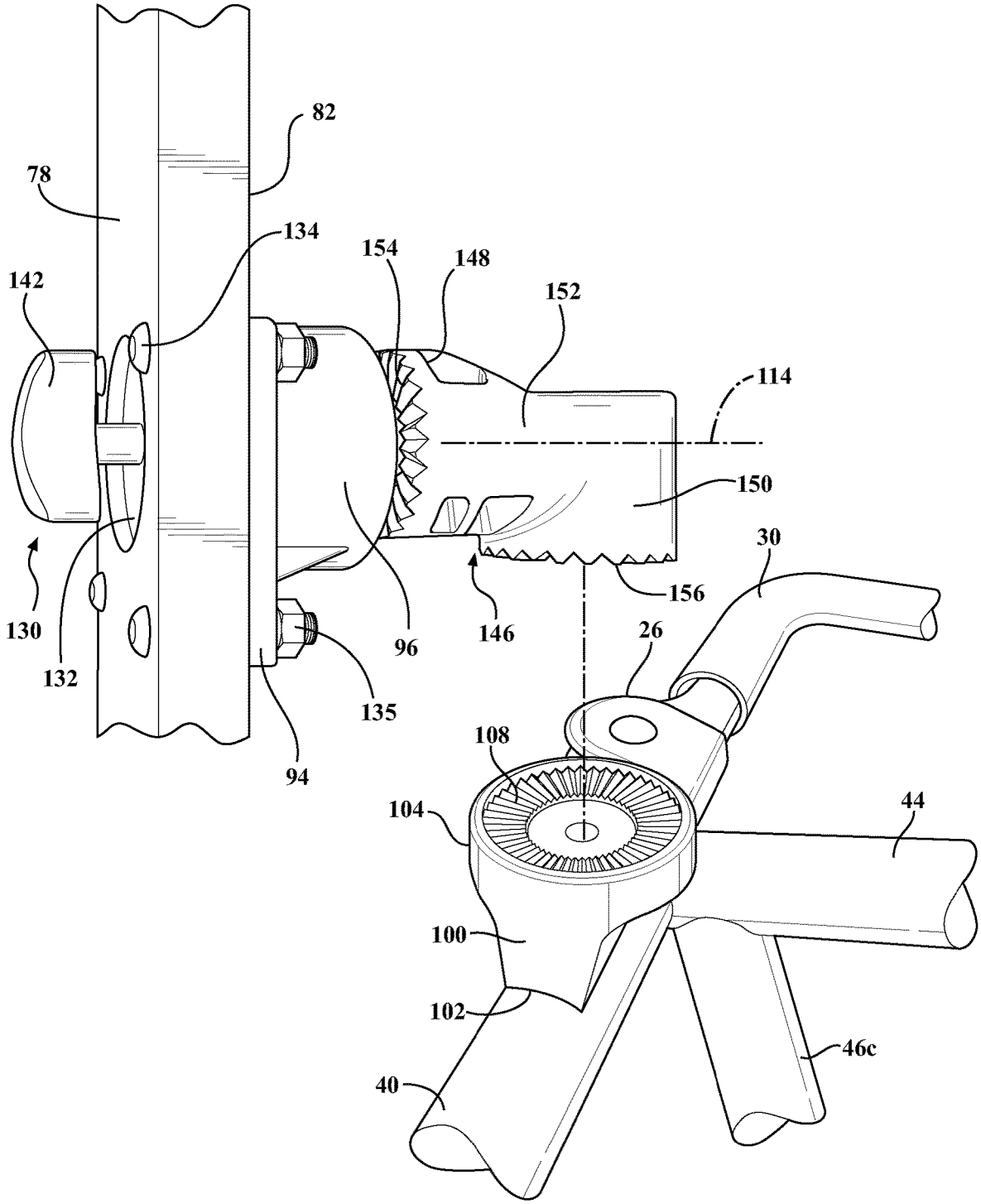
FIG. 10B is an exploded detailed view of the multi-directional knuckle assembly of FIG. 10A disassembled.
Figure 10C:
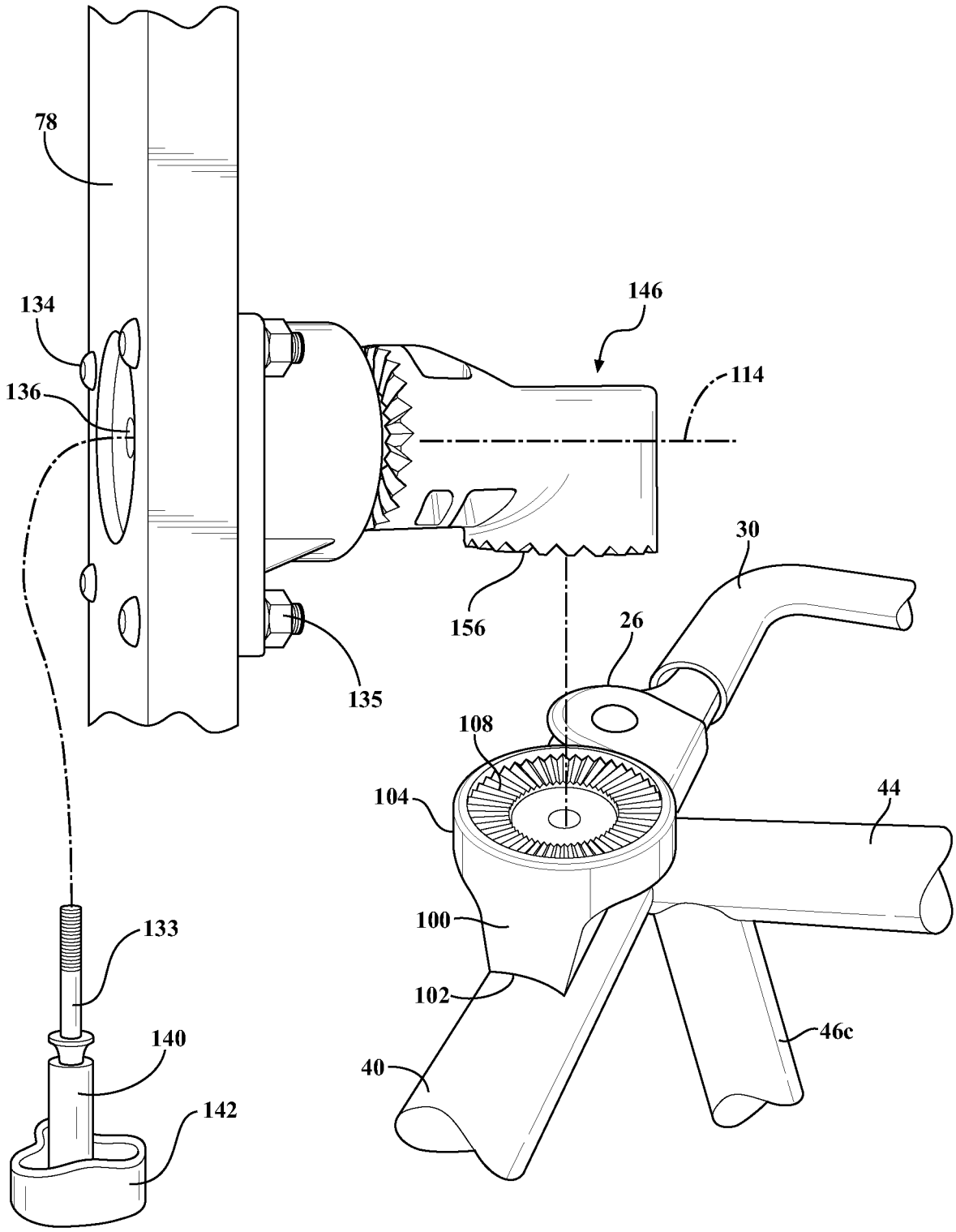
FIG. 10C is an exploded detailed view of the multi-directional knuckle assembly of FIG. 10A without the adjustment knob.
Figure 10D:
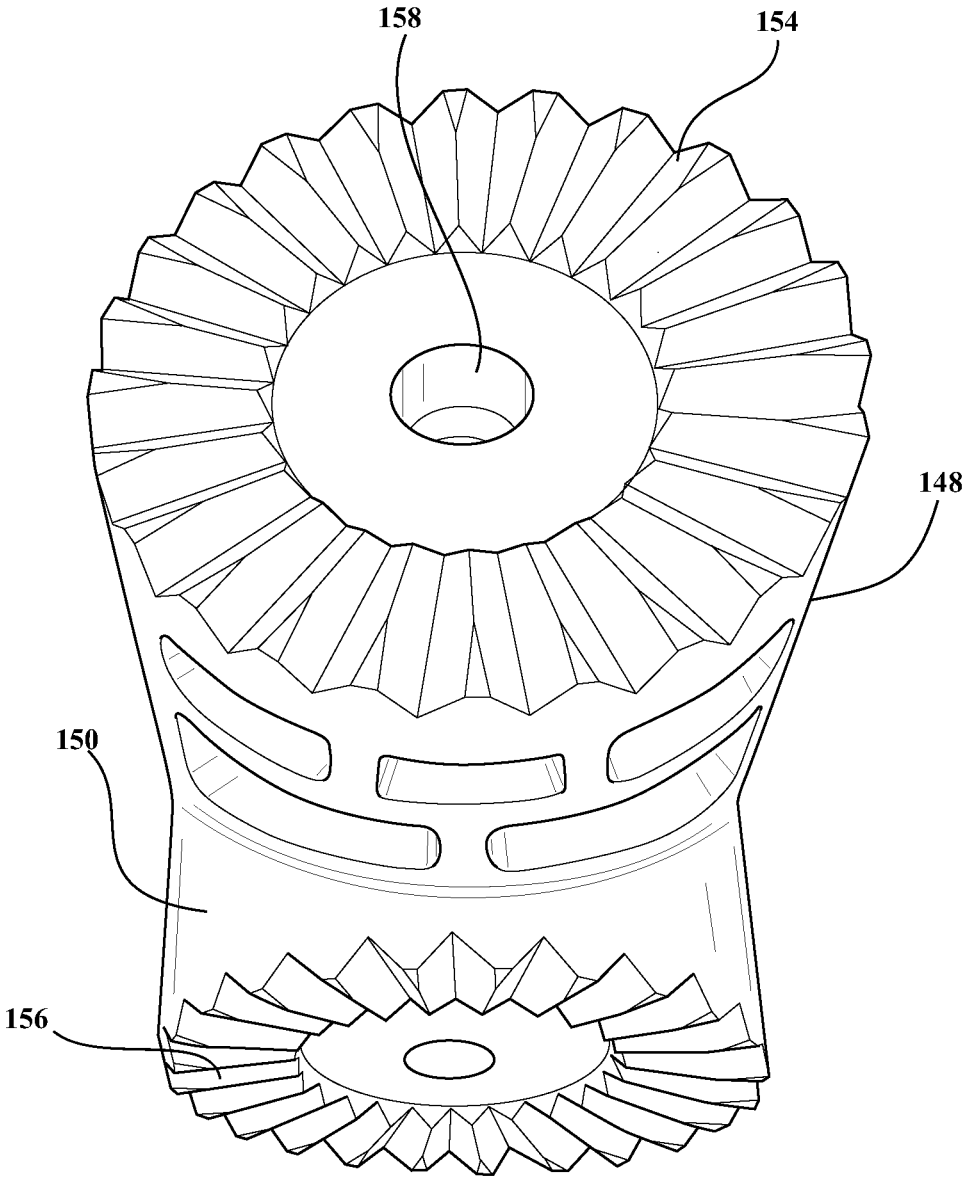
FIG. 10D is a detailed view of the male portion of the multi-directional knuckle assembly of FIG. 10A.

Referring to FIGS. 9A-9C, the armrests 70 can be selectively arranged in a variety of positions through the use of a multi-directional knuckle assembly 84. The multi-directional knuckle assembly 84 includes four pieces, an arm bracket 86, a male portion 88, a female portion 90 and an adjustment knob 92. The arm bracket 86 is attached to the secondary portion 74 of the armrest 70 and the female portion 90 is attached to the side member 40 of the lower body section 18 by means such as fasteners. The arm bracket 86 includes a flange 94 having a cylindrical portion 96 extending therefrom. The flange 94 rests flush against the lower surface 82 of the armrest 70 and the cylindrical portion 96 is configured to receive an end 98 of the male portion 88. Flange 94 may include at least four holes (not shown) for receipt of fasteners 124 for securing the arm bracket 86 to the armrest 70. Female portion 90 includes a shaped neck portion 100 having an underside 102 configured to correlate with the shape of side member 40 such that the female portion 90 rests flush upon the side member 40. Neck portion 100 includes a cylindrical top portion 104 extending therefrom. Fasteners (not labeled) are threaded through openings 106 formed through the female portion 90 to attach the female portion 90 to side member 40. Cylindrical top portion 104 is counter-sunk and includes internal teeth 108 formed circumferentially thereabout. Male portion 88 further includes an extension portion 110 extending from the end 98 and a cylindrical head portion 112 that extends transverse to a plane 114 defined by the extension portion 110. The cylindrical head portion 112 includes a first end 112*a* including external teeth 116 configured to engage the internal teeth 108 formed circumferentially about the cylindrical top portion 104 and a second end 118 that includes grooves 120 for receipt of a lower end of adjustment knob 92.

Multi-directional knuckle assembly 84 allows the armrest to rotate up-and-down in a direction that is transverse to the plane 76 of the side member 40 of the lower body section 18. A user would grasp the adjustment knob 92 and apply a torqueing movement causing the adjustment knob 92 to rotate. Rotation of the adjustment knob 92 causes engagement of external teeth 116 of the male portion 88 with the internal teeth 108 of the female portion 90. As the external teeth 116 of the male portion 88 engage with the internal teeth 108 of the female portion 90, the armrest 70 rotates incrementally up-and-down in a direction transverse to the plane of the side member 40 of the lower body section 18.

FIGS. 10A-10D detail an aspect of the armrest 70 wherein a multi-directional knuckle assembly 130 is provided and also allows the armrest 70 to rotate inward and outward 180 degrees parallel to the plane of the side member 40 of the lower body section 18. The multi-directional knuckle assembly 130 also includes four pieces, an arm bracket 86, a male portion 146, a female portion 90 and an adjustment knob 142. The arm bracket 86 is attached to the secondary portion 74 of the armrest 70 and the female portion 90 is attached to the side member 40 of the lower body section 18 by means such as fasteners. The arm bracket 86 includes a flange 94 having a cylindrical portion 96 extending therefrom. The flange 94 rests flush against the lower surface 82 of the armrest 70 and the cylindrical portion 96 is configured to receive an end 148 of the male portion 146. Flange 94 may include at least four holes (not shown) for receipt of fasteners 134 for securing the arm bracket 86 to the armrest 70. Fasteners 134 extend from the upper surface 78 of the armrest 70 through to lower surface 82 of the armrest 70 and are secured thereto by a nut 135. Cylindrical portion 96 is counter-sunk and includes teeth (not shown) that mate and interlock with external teeth 154 of the male portion 146. Female portion 90 includes a shaped neck portion 100 having an underside 102 configured to correlate with the shape of side member 40 such that the female portion 90 rests flush upon the side member 40. Neck portion 100 includes a cylindrical top portion 104 extending therefrom. Fasteners (not labeled) are threaded through openings 106 formed through the female portion 90 to attach the female portion 90 to side member 40. Cylindrical top portion 104 is counter-sunk and includes internal teeth 108 formed circumferentially thereabout. Male portion 148 further includes an extension portion 152 extending from the end 148 and a cylindrical head portion 150 that extends transverse to a plane 114 defined by the extension portion 152. The cylindrical head portion 150 includes external teeth 156 configured to engage the internal teeth 108 formed circumferentially about the cylindrical top portion. The upper surface 78 of the armrest 70 includes a cutout 132 to accommodate the adjustment knob 142. Adjustment knob 142 includes a neck portion 140 and a screw/fastener portion 133. The screw/fastener portion 133 is received within an aperture 136 formed in the cutout portion 132 and extending through the armrest 70 from the upper surface 78 to the lower surface 82, through another aperture (not shown) disposed in the cylindrical portion 96, and into an aperture 158 formed in the end 148 of the male portion 146.

Multi-directional knuckle assembly 130 allows the armrest 70 to rotate, in-and-out approximately 180 degrees in a direction parallel to the plane of the side member 40 of the lower body section 18. A user would grasp the adjustment knob 142 and apply a torqueing movement causing the adjustment knob 142 to rotate. Rotation of the adjustment knob 92 causes engagement of external teeth 154 of the male portion 146 with the internal teeth (not shown) of the cylindrical portion 96 of the arm bracket 86. As the external teeth 154 of the male portion 146 engage with the internal teeth (not shown) of the cylindrical portion 96, the armrest 70 rotates incrementally inwardly and outwardly in a direction parallel to the plane of the side member 40 of the lower body section 18. Multi-directional knuckle assembly 130 may also allow the armrest 70 to rotate in a combination of the incremental inward and outward rotation of 90 degrees a direction parallel to the plane of the side member 40 of the lower body section 18 as well as incrementally up-and-down in a direction transverse to the plane of the side member 40 of the lower body section 18.

Figure 11A:
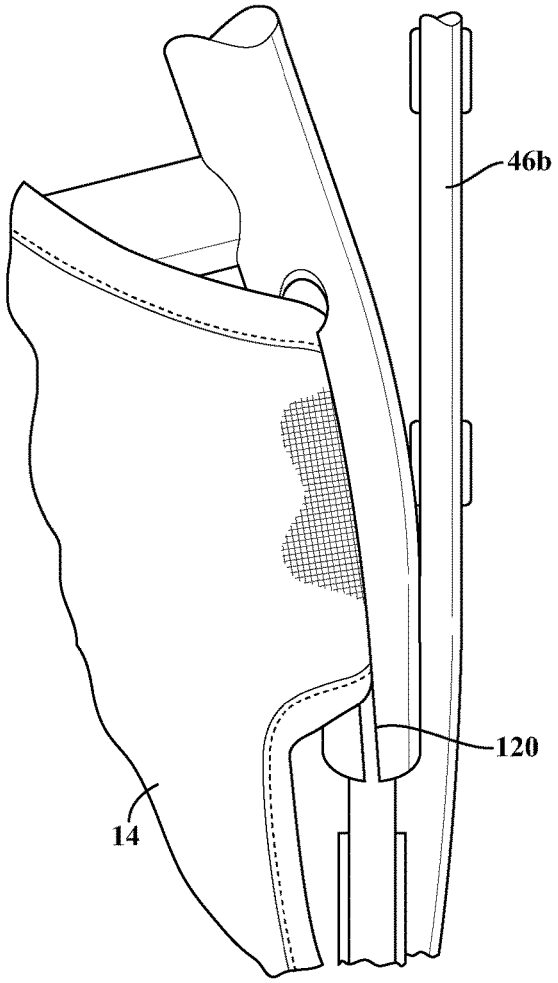
FIG. 11A is a fragmentary detailed view of the connection of the support material to the frame.
Figure 11B:
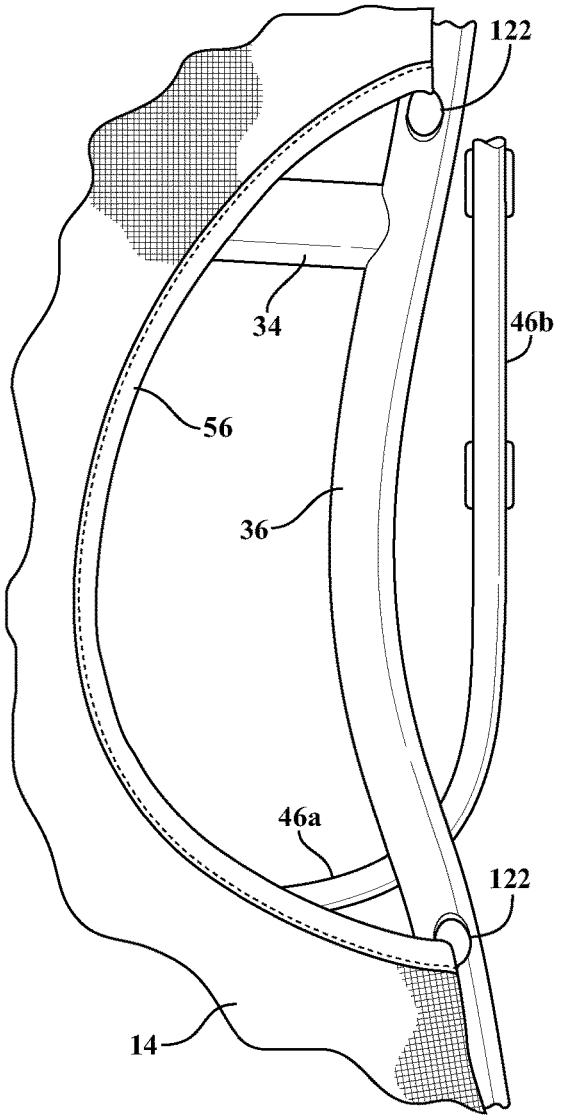
FIG. 11B is another fragmentary detailed view of the connection of the support material to the frame.

Referring to FIGS. 11A and 11B, side members 30 of the upper body section 16 of the frame 12 includes slots 120 positioned on opposing sides of the contoured shoulder drop 36. First ends 24 of the lower body section 18 also include slots 120. Each slot 120 begins with a widened portion 122. The peripheral edge of the support material 14 includes a rib, bead or retaining ring (not shown) that is received within the slots 120. The rib, bead or retaining ring (not shown) on the peripheral edge of the support material 14 is inserted into the widened portion 122 of the slots and maneuvered through the slots 120 about the frame 12 until the support material 14 is affixed taught to the frame 12.

Figure 12:
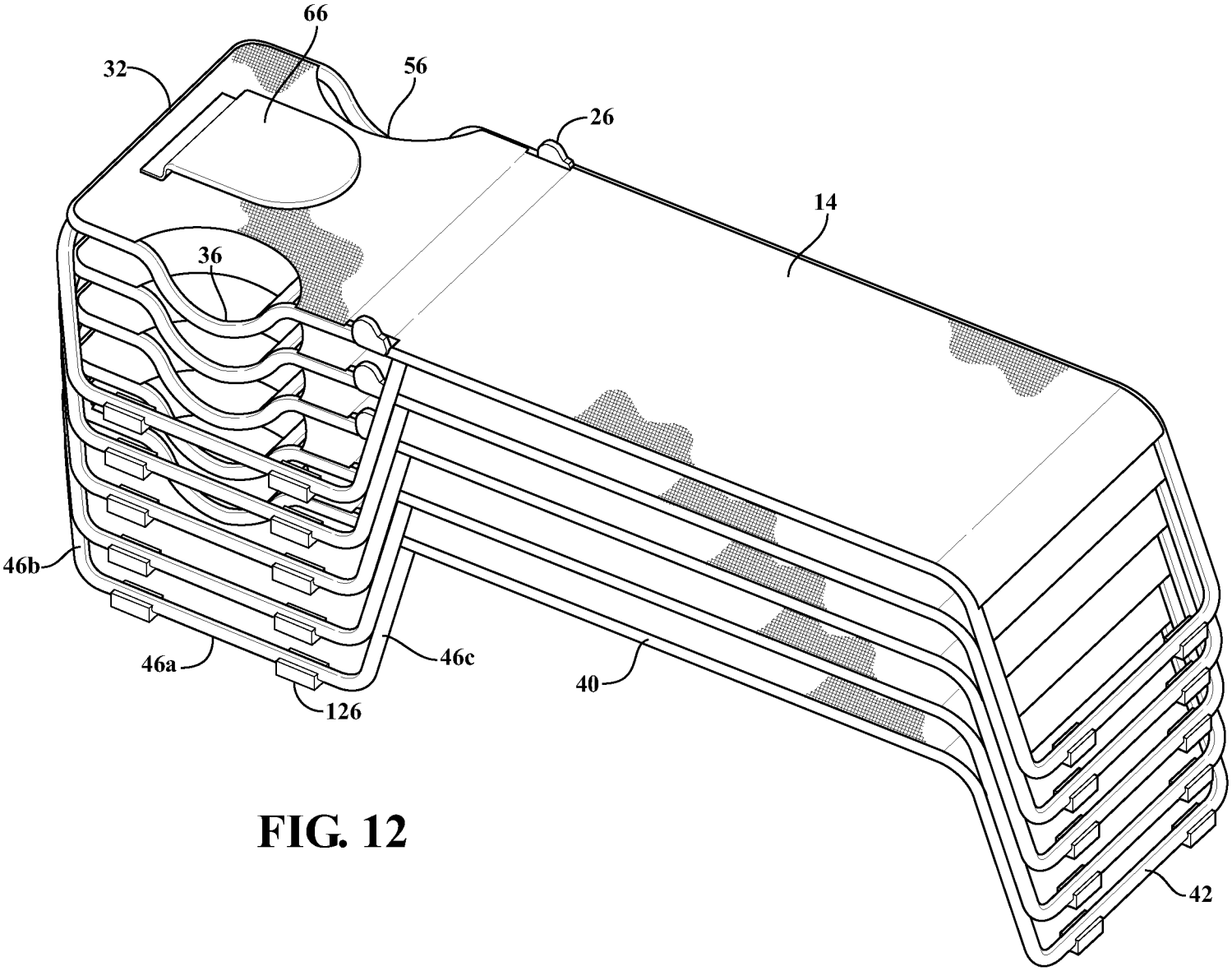
FIG. 12 is a perspective view of multiple lounge chairs in a stacked position, ready for storage.

Regarding FIG. 12, the lounge chairs 10 may be stacked for storage or transport, wherein each upper body section 16 is disposed directly adjacent another upper body section 16, each lower body section 18 is disposed directly adjacent another lower body section 18, and each support section 20 is disposed directly adjacent another support section 20. As such, each support section 20 and each shoulder drop 36 is received nestled within the adjacent support section 20 or shoulder drops 36, thereby allowing the upper body section 16 and the lower body sections 18 to fold compactly against the lower body sections 20 and lie in a stacked, parallel and slightly spaced position with respect to one another. The lounge chairs 10 can be stacked for storage or transport with or without the armrests attached.

The lounge chair 10 may also include an anterior tilt to help position the individual with respect to the shoulder drops 36 when the individual is lying on the lounge chair 10 in the supine position. The anterior tilt is achieved by the angled second portions 40*b* of the side members 40. Configuring the angled portions 40*b* to extend outwardly away from a plane 50 that is normal to a plane 52 of the lower body section 18 by approximately eight degrees of the entire frame 12 from the upper body section 16 to the lower body section 18 creates the anterior tilt. The eight degree tilt causes the head of a user to be slightly elevated thereby assisting with maintaining the natural curvature of the spine ensuring that a distance between the ear and shoulder remains consistent alleviating the pinch point or commonly known sweet spot caused from added localized pressure. The anterior tilt along with the structure of the support section 20 also prevents the lounge chair 10 from flipping over on the user. It is appreciated that the anterior tilt may be more or less than eight degrees without varying from the scope of the invention but a value greater than zero degrees, i.e., horizontal, is generally preferable.

Additionally, the lounge chair 10 may include levelers 126 that assist with ensuring that the lounge chair 10 is level with the floor or ground 21 and/or clamps 128 that receive and secure top member 32 of the upper body section 16 in place when the upper body section 16 is positioned in the laying position and when the lounge chairs 10 are stacked for transport or storage.

The invention has been described in an illustrative manner, and it is to be understood that the terminology used is intended to be in the nature of words of description rather than limitation. Many modifications and variations of the present invention are possible in light of the above teachings. It is, therefore, to be understood that within the scope of the appended claims, the invention may be practiced other than as specifically enumerated within the description.

What is claimed:

1. A lounge chair for supporting an individual in a supine or prone position, said lounge chair comprising:

a frame having an upper body section, a lower body section, and a support section, said support section coupled to a pair of free ends of the lower body section;

a support material coupled to and extending between the upper body section and the lower body section;

wherein said upper body section is operatively coupled to said lower body section to pivot between a plurality of angular positions, said upper body section including an aperture extending through said support material to receive a face of the individual when lying in the supine position; and wherein said upper body section includes spaced apart side members coupled together by a top member defining a plane therebeween, each of said side members of said upper body section including a shoulder drop portion that is offset and extends below said plane defined by said side members and said top member, said shoulder drops providing clearance for the shoulders and arms of the individual when lying in the supine position.

2. The lounge chair as set forth in claim 1 wherein said lower body section includes spaced apart side members coupled together by a bottom member, said side members including a first portion and a second portion extending between said first portion and said bottom member and that is angled relative to a plane defined by said first portions of said side members of said lower body section.

3. The lounge chair as set forth in claim 2 further including a pair of armrests operatively coupled to said lower body section for movement between a raised position, wherein an upper surface of said pair of armrests is offset below a plane defined by said upper body section, and a lowered position, wherein said upper surface of said pair of armrests is offset above said plane defined by said side member of said lower body section.

4. The lounge chair as set forth in claim 3 wherein said angled second portion of said lower body section thereby defines an anterior tilt of approximately eight degrees relative to the horizontal.

5. The lounge chair as set forth in claim 4 wherein the lower body section includes an intermediate member extending between said side members and having a curved contour such that the curved contour allows a person to lay on the lounge chair without having contact with the intermediate member.

6. The lounge chair as set forth in claim 5 further including a knuckle assembly operatively coupling each of said armrests to said lower body section to provide incremental inward and outward rotation of said armrest in a direction parallel to said plane of the side member of said lower body section and incrementally up and down rotation of said armrest in a direction transverse to said plane of said side member of said lower body section.

7. A lounge chair for supporting an individual in a supine or prone position, said lounge chair comprising:

a frame having an upper body section, a lower body section, and a support section, said support section coupled to a pair of free ends of the lower body section;

a support material coupled to and extending between the upper body section and the lower body section;

wherein said upper body section is operatively coupled to said lower body section to pivot between a plurality of angular positions; and a pair of armrests operatively coupled to said lower body section for movement between a raised position, wherein an upper surface of said pair of armrests is offset below a plane defined by said upper body section, and a lowered position, wherein said upper surface of said pair of armrests is offset above said plane defined by said side member of said lower body section.

8. The lounge chair as set forth in claim 7 wherein said upper body section includes spaced apart side members coupled together by a top member defining a plane therebeween, each of said side members of said upper body section including a shoulder drop portion that is offset and extends below said plane defined by said side members and said top member, said shoulder drops providing clearance for the shoulders and arms of the individual when lying in the supine position.

9. The lounge chair as set forth in claim 8 wherein said lower body section includes spaced apart side members coupled together by a bottom member, said side members including a first portion and a second portion extending between said first portion and said bottom member and that is angled relative to a plane defined by said first portions of said side members of said lower body section.

10. The lounge chair as set forth in claim 9 wherein said angled second portion of said lower body section thereby defines an anterior tilt of approximately eight degrees relative to the horizontal.

11. The lounge chair as set forth in claim 10 wherein the lower body section includes an intermediate member extending between said side members and having a curved contour such that the curved contour allows a person to lay on the lounge chair without having contact with the intermediate member.

12. The lounge chair as set forth in claim 11 further including a knuckle assembly operatively coupling each of said armrests to said lower body section to provide incremental inward and outward rotation of said armrest in a direction parallel to said plane of the side member of said lower body section and incrementally up and down rotation of said armrest in a direction transverse to said plane of said side member of said lower body section.

* * * * *